United States Patent [19]

Gotanda

[11] Patent Number: 4,852,374

[45] Date of Patent: Aug. 1, 1989

[54] ELECTRICAL SHOCK-PREVENTABLE KEY UNIT

[76] Inventor: Motohiro Gotanda, 1802-10, Nakabyo, Abiko-shi, Chiba-ken, Japan

[21] Appl. No.: 160,199

[22] Filed: Feb. 25, 1988

[30] Foreign Application Priority Data

Feb. 28, 1987 [JP] Japan ..... 62-28111[U]

[51] Int. Cl.[4] ..... A47G 29/10

[52] U.S. Cl. ..... 70/456 R; 206/38.1; 361/212

[58] Field of Search ..... 70/456 R; 361/212, 220; 206/37.1, 37.2, 38, 38.1; 340/825.3, 825.31

[56] References Cited

U.S. PATENT DOCUMENTS

| | | | |
|---|---|---|---|
| 1,974,547 | 9/1934 | Slade | 70/456 R |
| 2,550,375 | 4/1951 | Pentek | 70/456 R |
| 2,575,424 | 11/1951 | Mitchell | 70/456 R |
| 3,462,183 | 8/1969 | Dudley et al. | 361/220 X |
| 3,621,164 | 11/1971 | Backer | 361/220 X |
| 3,672,192 | 6/1972 | Dontas | 70/456 R X |
| 4,570,200 | 2/1986 | Osada et al. | 361/220 X |
| 4,633,364 | 12/1986 | Nakamura et al. | 361/220 X |

FOREIGN PATENT DOCUMENTS

| | | | |
|---|---|---|---|
| 562077 | 11/1957 | Belgium | 70/456 R |
| 416964 | 1/1967 | Switzerland | 70/456 R |
| 510358 | 7/1939 | United Kingdom | 70/456 R |
| 530249 | 12/1940 | United Kingdom | 70/456 R |

*Primary Examiner*—Lloyd A. Gall

*Attorney, Agent, or Firm*—Stephen F. K. Yee

[57] ABSTRACT

An electrical shock-preventable key unit has a case for slidably accommodating a key body, a slide plate and an electrical shock preventing system. The slide plate engages with the key body and slides reciprocally to position it in the extended position or in the retracted position. The electrical shock preventing system comprises a conductive member provided on the case, a resistor for attenuating the current due to static electricity, and a conductive contact piece which comes into contact with the key body in the extended position, and operates to prevent the user from receiving an electrical shock upon locking or unlocking.

5 Claims, 4 Drawing Sheets

ELECTRICAL SHOCK-PREVENTABLE KEY UNIT

BACKGROUND OF THE INVENTION

1. Field of the Invention

This invention relates to an electrical shock-preventable key unit which can prevent the occurrence of an electrical shock in a human body due to the discharge of static electricity upon locking or unlocking a door with a key.

2. Description of the Piror Art

In the case where a man stays in a building such as an office, a hotel, etc. with a carpet on its floor, his body is apt to be charged with static electricity. Thus, when he inserts a key with his hand in the lock of a door for locking or unlocking same, the static electricity charged on his body discharges instantaneously through the key to the earthed door. As a result, he oftens get a shock of electricity. On the other hand, as for a motorcar, since the car body is insulated from the earth by rubber tires and is not electrically connected to the ground, the car body is charged with static electricity. Thus, when a driver inserts a key into a door lock of the car, the static electricity charged on the car body sometimes discharges to his body through the key, thereby giving him in electrical shock.

In order to solve these problems, the present inventor has proposed a key unit which can prevent an electrical shock upon locking or unlocking with a key in Japanese Utility Model Laid-Open No. 91962/1986. FIGS. 1(*a*-)–1(*c*) depict the proposed key unit. FIG. 1(*a*) is a plan view of the key unit, FIG. 1(*b*) is a plan view of the key unit, with the upper half of a case removed, and FIG. 1(*c*) is a view for illustrating an adapter. In these Figures, the reference numeral 1 represents the key unit which comprises a key body 2, a case 3, conducting plates 4 (4*a*, 4*b*), an adapter 5, a contact piece 6 and a resistor 7. The key body 2 is made of a conductive material and comprises a key portion 2*a* and a grip portion 2*b*. The key portion 2*a* projects from the case and is adapted to be inserted into the key hole of a door to be unlocked or locked. The case 3 comprises an upper half 3a and a lower half 3*b* each of which is made of an insulating material and which define an accommodating chamber for accommodating the key body 2. The upper half 3a is of the same construction as the lower half 3*b* and is fixed to the lower half 3*b*. The conductive plates 4*a* and 4*b* are provided on the surfaces of the upper half 3a and the lower half 3*b*, respectively. One end of the conductive plates 4*a* and 4*b* is folded to be substantially in the U-shaped form. The folded portions of the conductive plates 4*a* and 4*b* are connected to one end of the resistor 7. The adapter 5 is made of an insulating material and is used for fixing the key body 2 into the case 3. Namely, on assembling the key unit, the grip portion 2*b* is fitted in the adapter 5 as shown in FIG. 1(*c*) and then the adapter 5 with the key body 2 is fitted in the accommodating chamber of the case 3 as shown in FIG. 1(*b*). The contact piece 6 connects the grip portion 2*b* to the other end of the resistor 7.

When the key unit having the above construction is used, the user's fingers touch the contacting plates 4*a* and 4*b*. At this time, the static electricity charged on his body discharges along the route from the human body through the conductive plates 4*a* and 4*b*, the resistor 7 and the key body 2 to the lock of the earthed door. Accordingly, an electrical shock upon locking or unlocking can be prevented, if the resistance value of the resistor 7 is high enough.

With such a key unit, however, inconvenience is experienced during use or carriage, since the key unit is large sized.

SUMMARY OF THE INVENTION

Accordingly, it is an object of this invention to provide an electric shock-preventable key unit which can prevent the user from receiving an electric shock.

It is another object of this invention to provide an electric shock-preventable key unit which is small-sized and quite handy to carry or keep.

In accomplishing the foregoing objects, the present invention provides an electric shock-preventable key unit comprising:

a case formed of an electrically insulating material and defining a longitudinally extending chamber therein;

a longitudinally extending slot formed in said case;

an aperture formed at one end of said case;

a slide plate slidably disposed within said chamber and having a projection engaged with and protruded from said slot, so that said slide plate can be longitudinally slid between first and second positions by moving said projection along said slot, said slide plate being formed of an electrically insulating material;

a key body formed of an electrically conductive material and having a grip portion secured to said slide plate and a key portion extending from said grip portion, so that said key portion is extended out of said chamber through said aperture when said slide plate is located in said first position and retracted therefrom when said slide plate is located in said second position;

an electrically conductive member having a portion exposed on the surface of said case;

an electrically conductive contacting member provided in said chamber at a position so that said contacting member is electrically contacted with said grip portion when said slide plate is located in said first position; and a resistor having both terminals electrically connected to said conductive member and said contacting member, respectively.

BRIEF DESCRIPTION OF THE DRAWINGS

Other objects, features and advantages of the present invention will become apparent from the detailed description of the preferred embodiments of the invention which follows, when considered in the light of the accompanying drawings, in which:

FIG. 1(*b*) is a plan view of the key unit shown in FIG. 1(*a*) with the upper half of a case removed;

FIG. 1(*c*) is a view of an adapter used in FIG. 1(*a*) with a key body fitted thereto;

FIG. 2(*b*) is a sectional view taken alone line 2*b*—2*b* of FIG. 2(*a*);

FIG. 2(*c*) is a sectional view taken along line 2*c*—2*c* of FIG. 2(*b*);

FIG. 2(*d*) is a sectional view taken along line 2*d*—2*d* of FIG. 2(*b*);

FIG. 2(*e*) is a sectional view taken along line 2*e*—2*e* of FIG. 2(*a*) with the key body removed;

FIG. 2(*f*) is a bottom view of the key unit of FIG. 2(*b*);

FIG. 3(*b*) is a side view of FIG. 3(*a*);

DETAILED DESCRIPTION OF THE PREFERRED EMBODIMENTS

Figure 1A:
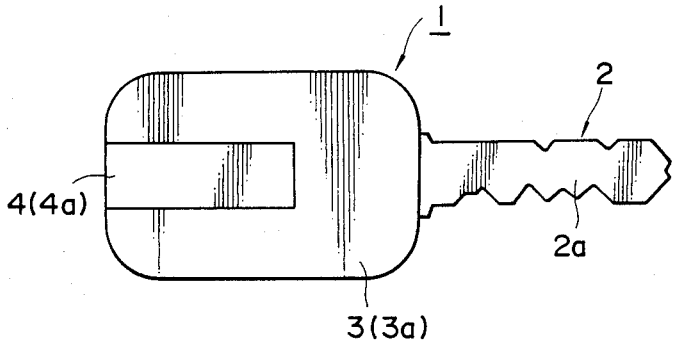
FIG. 1(a) PRIOR ART
FIG. 1(*a*) is a plan view of a conventional electric shock-preventable key unit.
Figure 1B:
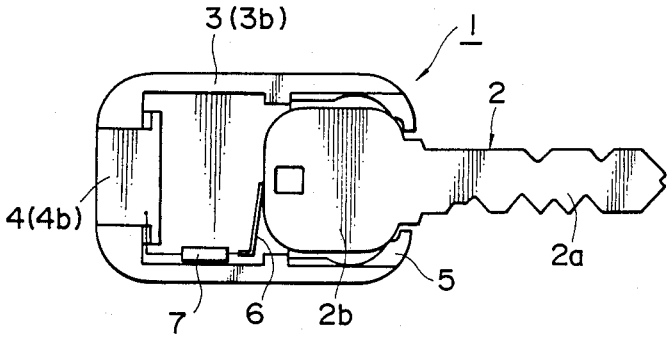
FIG. 1(b) PRIOR ART
Figure 1C:
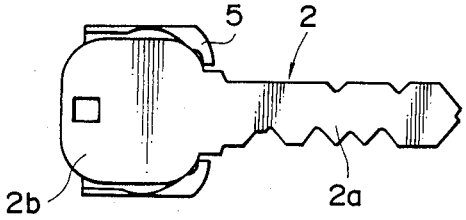
FIG. 1(c) PRIOR ART
Figure 2A:
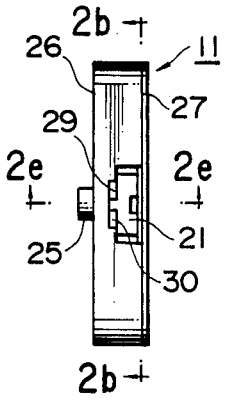
FIG. 2(*a*) is a front view of an electric shock-preventable key unit according to the present invention.
Figure 2C:
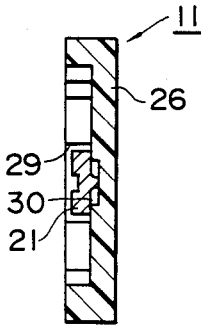
Figure 2B:
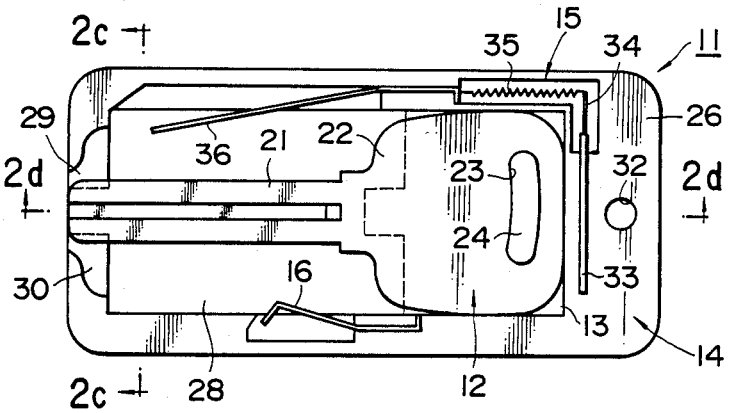
Figure 2D:
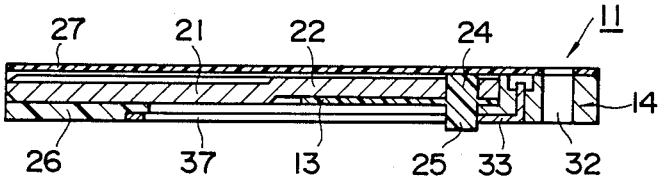
Figure 2E:
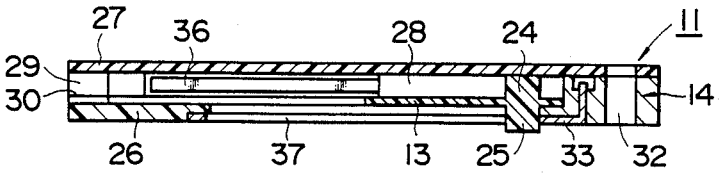
Figure 2F:
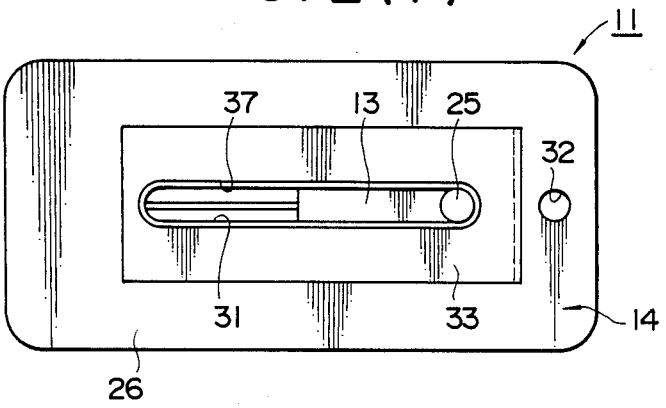
Figure 3A:
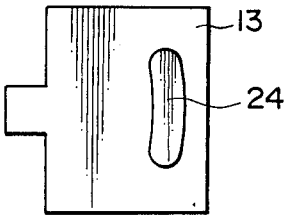
FIG. 3(*a*) is a plan view of a slide plate of FIG. 2(*b*)
Figure 3B:
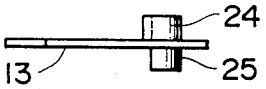

Referring now to FIGS. 2(*a*) to 2(*f*), designated generally as 11 is an electric shock-preventable key unit according to the present invention. The key unit 11 includes a key body 12, a slide plate 13, a case 14, an electric shock preventing system 15 and, preferably, retaining means 16.

The key body 12 is made of a conductive material and comprises a key portion 21 and a grip portion 22, as shown in FIG. 2(*b*). On both sides of the key portion 21, magnets (not shown) are embedded such that its N-pole and S-pole are arranged according to a predetermined coded pattern. The grip portion 22 has a through-hole 23 to be used for securing the key body 12 to the slide plate 13.

The slide plate 13 is formed of an insulating material and includes a first projection 24 which engages with the through-hole 23 of the grip portion of the key body 12 and a second projection 25 to be used for sliding the slide plate 13. The case 14 is made of an insulating material such as a synthetic resin and comprises a main case portion 26 and a cover portion 27 which define an accommodating portion 28 for slidably accommodating the key body 12 and the slide plate 13 engaged with the key body 12, and also has an aperture 29 through which the key portion 21 of the key body 12 can project in use.

The main case portion 26 has a shoulder 30 with which the base of the key portion 21 is engaged when the key body is in the extended (projected) position and to which the slide plate 13 abuts when the key body 12 is in the extended position. The main case portion 26 also has a long slot 31 with which the second projection 25 of the slide plate 13 is engaged. The case 14 has another through-hole 32 to be used for fitting a key holder, etc. thereto.

The shock preventing system 15 comprises a conductive member 33, a lead wire 34, a resistor 35 and a contact piece 36. The conductive member 33 is provided at the main case portion side and has a bent portion as shown in FIGS. 2(*d*) and 2(*e*). This bent end of the conductive member 33 is connected through the lead wire 34 to the one end of the resistor 35 which discharges static electricity gradually. The resistance value of the resistor 35 is selected not to give an electric shock to the user. Usually a high resistance value such as more than one megohm is suitably used for the resistor 35.

Figure 4:
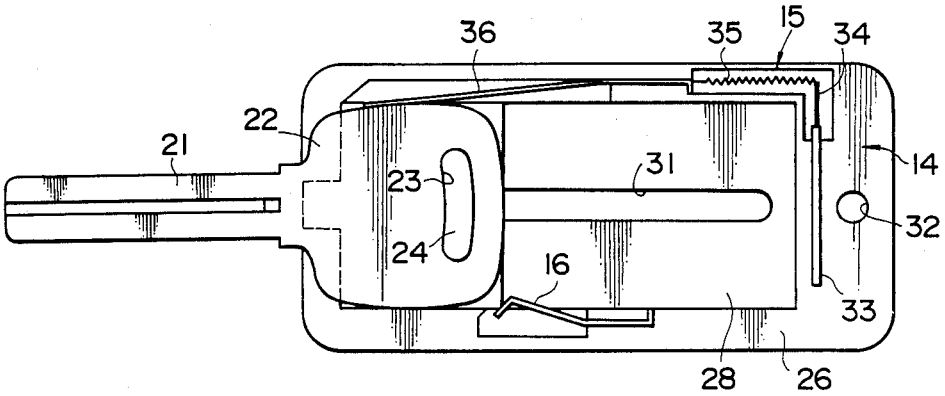
FIG. 4 is a plan view, similar to FIG. 2(*b*), showing the state of the key unit in use.

The contact piece 36 may be made of an elastic conductive material. One end of the contact piece 36 is connected to one end of the resistor 35 while the other end of the contact piece 36 comes into contact with the grip portion 22 of the key body 12 when the body 12 is in the extended position (as shown in FIG. 4).

The retaining means 16 is preferably provided for maintaining the key body 12 mounted on the slide plate 13 in the extended position so as to prevent the key portion 21 from returning to its retracted position during locking or unlocking operation. Preferably, as shown in FIG. 2(*b*), the retaining means 16 is a leaf spring or plate spring mounted on the main case portion 26 of the case 14 for engagement with the slide plate 13 upon its slide movement in both directions, thereby to prevent free sliding movement of the slide plate 13. The leaf spring 16 is so designed that its mechanical resistance is small when the second projection 25 of the slide plate 13 is pushed forward to project the key portion 21 of the key body 12 out of the case 14, but is large when the same is pushed backward to its retracted position.

In the embodiment shown, the conductive member 33 is a plate with a turned-up portion at one end (note FIGS. 2(*d*) and 2(*e*), right side) and a medial opening 37 extending around the periphery of the slot 31 (note FIG. 2(*f*)) in which the second projection slides. The position and shape of the conductive member are, however, not limited to such a specific embodiment.

The operation of the key unit 11 having the above construction is as follows. In use, the user holds the case 14 with his hand and pushes the second projection 25 of the slide plate 13 forward to slide the slide plate 13 against the spring force of the retaining means 16, whereby the key portion 21 of the key body 12 projects from the aperture 29 of the case 14. Then, the slide plate 13 engages with the retaining means 16 and is maintained in the extended position (FIG. 4). In this condition, the locking or unlocking operation is effected. If it is desired to return the key portion 21 of the key body 12 to the retracted position as shown in FIG. 2(*b*), the user pushes the second projection 25 of the slide plate 13 backward against the spring force (which is set to be greater than that experienced in the forward direction) of the retaining means 16.

When the user holds the key unit 11 with his body being charged with static electricity, the current due to the static electricity flows from his body through his fingers, the conductive member 33, the lead wire 34, the resistor 35 to the contact piece 36. By sliding the second projection 25 of the slide plate 13 forward to extend the key portion 21 of the key body 12, the grip portion 22 of the key body 12 comes into contact with the contact piece 36 as shown in FIG. 4, so that the current due to the static electricity flows into the key body 12 out of the case 14. When the key portion 21 of the key body 12 is inserted into the key hole of a door (not shown), the static electricity charged on the user and on the key body 12 is discharged through the key hole to the earthed door. Therefore, an electric shock can be prevented from ocurring so long as the resistance value of the resistor 35 is suitably selected to reduce the current value.

Figure 5A:
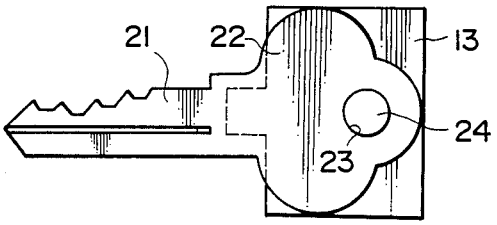
FIGS. 5(*a*) and 5(*b*) are plan views showing variants of a key body of the slide plate.
Figure 5B:
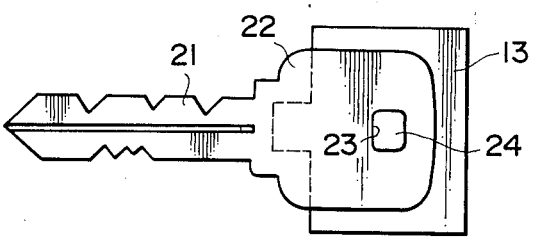

FIGS. 5(*a*) and 5(*b*) are plan views illustrating the variations of the key body 12. As shown, the present invention can be applied to keys of various kinds and forms by simply changing the form of the first projection 24 of the slide plate 13.

Having described this invention in connection with one preferred embodiment, it is to be understood that the present invention is not limited to the above embodiment and many modifications can be made within the technical concept of this invention. For example, although the retaining means 16 and the contact piece 36 are used in the above embodiment, the retaining means may be omitted. In this case, if desired, the contact piece 36 may be shaped into the form of a plate spring so that it can also serve to function as the retaining means. Further, while the conductive member 33 is bent to provide a connecting terminal for the lead wire 34, the electrical connection between the conductive member 33 and the resistor 35 may be established by inserting a conductive pin into the conducting member in lieu of the bent portion. Additionally, if desired, a part of the key portion 21 may be projected from the case 14 when the key body 12 is in the retracted position. Although the conductive member 33 is provided at one surface of the case 14 in the above embodiment, the conductive member 33 may be so designed as to have two or more portions exposed to the surface of the case 14.

What is claimed is:

1. An electric shock-preventable key unit comprising:

a case formed of an electrically insulating material and having a longitudinally extending chamber therein;

a longitudinally extending slot formed in said case;

an aperture formed at one end of said case;

a slide plate slidably disposed within said chamber and having a projection engaged with and protruded from said slot, so that said slide plate can be longitudinally slid between first and second positions by moving said projection along said slot, said slide plate being formed of an electrically insulating material;

a key body formed of an electrically conductive material and having a grip portion secured to said slide plate and a key portion extending from said grip portion, so that said key portion is extended out of said chamber through said aperture when said slide plate is located in said first position and retracted therefrom when said slide plate is located in said second position;

an electrically conductive member having a portion exposed on the surface of said case;

an electrically conductive contacting member provided in said chamber at a position so that said contacting member is electrically contacted with said key grip portion when said slide plate is located in said first position;

a resistor having both terminals electrically connected to said conductive member and said contacting member, respectively; and retaining means coacting with said slide plate to maintain said slide plate in said first position with said key portion extended from said chamber, said retaining means comprising a plate spring disposed on said case and having a portion for engagement with said slide plate, said engagement portion being shaped to provide a lower mechanical resistance to sliding movement of said slide plate to said first position from said second position and to provide a greater mechanical resistance to sliding movement of said slide plate to said second position from said first position.

2. A key unit according to claim 1, wherein said contacting member is formed into a spring so that the key portion is maintained in its extended direction when the grip portion comes into contact with said contacting member.

3. A key unit according to claim 1, wherein said grip portion has a through-hole and said slide plate has a protruded portion with which said through-hole is engaged for securing said grip portion to said slide plate.

4. A key unit according to claim 1, wherein said plate spring engagement portion has a shape of an inverted V with one inclined surface facing said aperture and the other inclined surface facing away from said aperture, said surfaces being contacted by said slide plate during movements between said first and second positions.

5. A key unit according to claim 4, wherein said one inclined surface of the plate spring engagement portion is disposed at a larger angle relative to the horizontal direction of movement of said slide plate than the angle at which said other inclined surface is disposed, to provide said greater mechanical resistance.

* * * * *